US008122677B2

(12) United States Patent
Yuers

(10) Patent No.: US 8,122,677 B2
(45) Date of Patent: Feb. 28, 2012

(54) METHOD AND SYSTEM FOR CONSTRUCTING A CONCRETE WATERSTOP JOINT AND USE OF A CEMENTITIOUS AND REACTIVE WATERPROOFING GROUT STRIP

(75) Inventor: Kevin Yuers, Delta (CA)

(73) Assignee: KHI Capital Inc., Vancouver (CA)

( * ) Notice: Subject to any disclaimer, the term of this patent is extended or adjusted under 35 U.S.C. 154(b) by 605 days.

(21) Appl. No.: 11/569,435

(22) PCT Filed: May 20, 2005

(86) PCT No.: PCT/CA2005/000778

§ 371 (c)(1),
(2), (4) Date: Nov. 21, 2006

(87) PCT Pub. No.: WO2005/116354

PCT Pub. Date: Dec. 8, 2005

(65) Prior Publication Data

US 2007/0245658 A1 Oct. 25, 2007

Related U.S. Application Data

(60) Provisional application No. 60/574,291, filed on May 24, 2004.

(51) Int. Cl.
*E04G 23/00* (2006.01)

(52) U.S. Cl. ..... 52/742.16; 52/169.14; 52/411; 52/514.5; 52/416

(58) Field of Classification Search ..... 52/416, 52/417, 420, 428, 396.06, 396.02, 514.5, 52/742.16, 169.14, 411, 412, 716.2, 718.01, 52/718.04

See application file for complete search history.

(56) References Cited

U.S. PATENT DOCUMENTS

| | | | | |
|---|---|---|---|---|
| 3,023,681 | A * | 3/1962 | Worson | 404/49 |
| 4,103,499 | A * | 8/1978 | Clem | 405/229 |
| 4,209,568 | A * | 6/1980 | Clem | 428/454 |
| 4,424,867 | A * | 1/1984 | Mallow | 169/43 |
| 4,758,003 | A * | 7/1988 | Goldstein et al. | 277/314 |

(Continued)

FOREIGN PATENT DOCUMENTS

DE 19938368 A1 4/2000

(Continued)

OTHER PUBLICATIONS

"Bentonite." Encyclopædia Britannica. 2010. Encyclopædia Britannica Online. Oct. 20, 2010 <http://www.britannica.com/EBchecked/topic/61219/bentonite>.*

(Continued)

*Primary Examiner* — William Gilbert
*Assistant Examiner* — James Ference
(74) *Attorney, Agent, or Firm* — Nexus Law Group LLP

(57) ABSTRACT

A method and system for constructing a concrete waterstop joint between first and second concrete portions. The method may include applying a continuous longitudinal cementitious and reactive waterproofing grout strip to a joint area of the first concrete portion and then forming the second concrete portion over the grout strip. The system may include a first concrete portion having a joint area, a continuous cementitious and reactive waterproofing longitudinal grout strip connectable to the joint area, and a second concrete portion formable over the grout strip. There is also provided a use of a cementitious and reactive waterproofing grout strip in the construction of a concrete waterstop joint between first and second concrete portions.

24 Claims, 1 Drawing Sheet

U.S. PATENT DOCUMENTS

| | | | | |
|---|---|---|---|---|
| 4,837,085 | A * | 6/1989 | McGroarty | 428/451 |
| 4,997,695 | A * | 3/1991 | Clem | 428/76 |
| 5,034,160 | A * | 7/1991 | Kindt et al. | 252/604 |
| 5,482,737 | A * | 1/1996 | Gaveske | 427/140 |
| 5,487,250 | A * | 1/1996 | Yount et al. | 52/417 |
| 5,576,065 | A * | 11/1996 | Gaveske | 427/407.1 |
| 5,584,926 | A * | 12/1996 | Borgholm et al. | 106/713 |
| 5,624,714 | A * | 4/1997 | Gaveske | 427/393.6 |
| 5,628,159 | A * | 5/1997 | Younts | 52/417 |
| 5,736,197 | A * | 4/1998 | Gaveske | 427/393 |
| 5,737,889 | A * | 4/1998 | Habberstad et al. | 52/396.02 |
| 5,953,864 | A * | 9/1999 | Beck | 52/127.11 |
| 6,080,234 | A * | 6/2000 | Clavaud et al. | 106/644 |
| 6,115,979 | A * | 9/2000 | Horstketter et al. | 52/393 |
| 6,224,700 | B1 * | 5/2001 | Oakley | 156/71 |
| 6,344,253 | B1 * | 2/2002 | Pioventini | 428/73 |
| 6,449,914 | B1 * | 9/2002 | Horstketter et al. | 52/393 |
| 6,692,566 | B2 * | 2/2004 | Kelly | 106/716 |
| 6,739,805 | B2 * | 5/2004 | Shotton | 405/267 |
| 6,948,716 | B2 * | 9/2005 | Drouin | 277/606 |
| 7,437,855 | B2 * | 10/2008 | Locke et al. | 52/169.14 |
| 2003/0208982 | A1 * | 11/2003 | Korman et al. | 52/596 |
| 2006/0020048 | A1 * | 1/2006 | O'Kane | 521/99 |

FOREIGN PATENT DOCUMENTS

| | | | |
|---|---|---|---|
| EP | 0692584 | A1 | 1/1996 |
| WO | 91/18946 | A1 | 12/1991 |

OTHER PUBLICATIONS

Fritz T. Madsen and Max Muller-Vonmoos, "The Swelling Behaviour of Clays", Applied Clay Science, 4 (1989), p. 143-156, Elsevier Science Publishers B.V., Amsterdam.

Tan Luorong and Kong Lingwei, "Study of swelling-shrinkage regularity of montmorillonite crystal and its relation with matric suction", Science in China (Series D), vol. 44, No. 6, Jun. 2001, p. 498-507.

E.E. Alonso et al., "Expansive bentonite-sand mixtures in cyclic controlled-suction drying and wetting", Engineering Geology 81 (2005), p. 213-226, Elsevier B.V., available online at <<www.sciencedirect.com>>.

* cited by examiner

METHOD AND SYSTEM FOR CONSTRUCTING A CONCRETE WATERSTOP JOINT AND USE OF A CEMENTITIOUS AND REACTIVE WATERPROOFING GROUT STRIP

CLAIM OF PRIORITY

This application claims the benefit of priority under 35 U.S.C. §119(e) to U.S. Provisional Application No. 60/574,291, filed May 24, 2004, the specification and drawings of which are hereby expressly incorporated by reference.

FIELD OF THE INVENTION

The invention is directed to concrete construction joints, and more specifically to a method and system for constructing a concrete waterstop joint and a use of a cementitious and reactive waterproofing grout strip.

BACKGROUND OF THE INVENTION

In concrete construction joints, such as a wall-to-slab intersection; mechanical methods of preventing water leakage through the joint, such as installing a membrane or liner between adjacent concrete pieces, may be employed.

For example, a membrane fabricated from a nonporous or water-impermeable membrane, such as a strip of plastic, may be partially longitudinally embedded in a horizontal slab, such that part of the membrane protrudes generally upward from the slab surface. A vertical wall may then be poured over the protruding part, fully embedding the membrane in the joint and forming a barrier to water migration. However, such a construction may not prevent water and waterborne chemicals to seep into capillaries and other crevices in the surrounding concrete and thus migrate around the membrane. Moreover, the membrane may become brittle from age or mechanical fatigue and crack, allowing water to pass directly through the barrier.

Alternatively, a liner made from a porous material, such as clay, may be interposed between adjacent concrete pieces, such as to trap and absorb migrating moisture. However, moisture absorption may cause such a liner to swell. However, upon drying the liner will shrink. Repeated cycles will cause the liner to fail.

Accordingly, a need exists for an improved method and system for preventing water leakage through a concrete joint which overcomes the deficiencies noted above and that is easy and quick to use. Other objects of the invention will be apparent from the description that follows.

SUMMARY OF THE INVENTION

According to the present invention there is provided a method of constructing a concrete waterstop joint between first and second concrete portions. The method may include applying a continuous longitudinal cementitious and reactive waterproofing grout strip to a top surface of a joint area of the first concrete portion and forming the second concrete portion over the grout strip.

The method may further include bringing the top surface of the joint area of the first concrete portion to a saturated/surface dry (SSD) condition prior to applying the continuous longitudinal cementitious and reactive waterproofing grout strip. The method may also further include applying a cementitious and reactive waterproofing slurry to the top surface of the joint area and/or to the grout strip and forming the second concrete portion over the top surface of the joint area.

According to another embodiment of the present invention there is provided a use of a cementitious and reactive waterproofing grout strip comprising applying the grout strip to a top surface of a joint area of a first concrete portion in the construction of a concrete waterstop joint between the first concrete portion and a second concrete portions portion.

A cementitious and reactive waterproofing slurry may also be used on the top surface of the joint area and/or grout strip.

According to yet another embodiment of the present invention there is also provided a system of constructing a concrete waterstop joint. The system may include a first concrete portion having a top surface joint area, a continuous cementitious and reactive waterproofing longitudinal grout strip connectable to the top surface joint area, and a second concrete portion formable over the grout strip.

The system may include a cementitious and reactive waterproofing slurry applicable to the top surface joint area and/or grout strip and a second concrete portion formable over the top surface joint area.

The grout strip may be formed to have a triangular cross-section with an altitude to base ratio of 3:5 which may be substantially positioned along the center-line of the top surface joint area.

The cementitious and reactive waterproofing slurry may conform to CSI Master Format 2004 071600 and 071616. The cementitious and reactive waterproofing slurry may be Krystol™ or Xypex™mixture.

BRIEF DESCRIPTION OF THE DRAWINGS

The preferred embodiment of the invention will be described by reference to the drawings thereof in which.

DESCRIPTION OF THE PREFERRED EMBODIMENT OF THE INVENTION

Figure 1:
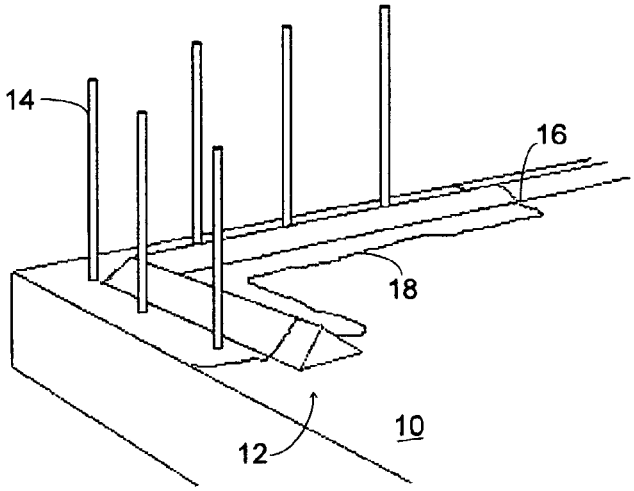
FIG. 1 is an isometric drawing of a portion of a concrete slab with a continuous grout strip applied to a top surface of a joint area. The top surface of the joint area and strip are both treated with sealant slurry, and several pieces of rebar extend vertically from the joint area.

FIG. 1 illustrates a concrete slab 10 with a joint area 12 corresponding to the location of an intended concrete wall (not illustrated). Rebar 14 extends vertically from the slab 10 through the joint area 12. To prepare the joint area 12 for receiving the intended concrete wall, the surface should be sound, clean and free of contaminants and debris. Preferably, the top surface of joint area 12 is brought to a saturated/surface-dry (SSD) condition such that the pores of the slab 10 are completely saturated with water, but no free water remains on the top surface. Pre-soaking the joint area 12 with water and then removing excess water with a towel may bring the joint area surface to a SSD condition.

Once the joint area 12 has been prepared, a continuous longitudinal grout strip 16 may then be formed on the top surface of the joint area 12 using a trowel or other similar shaping tool. The grout 16 or putty may be a concentrated aqueous suspension of slurry sealant (discussed below).

Here, the grout strip 16 runs generally parallel to a line formed by the rebar 14 and is formed substantially along the center-line of the joint area 12. Although the grout strip 16 is shown positioned to one side of the rebar 14, it may optionally be positioned to the other side, or partially or completely surrounding the point of intersection of the rebar with the concrete surface. Optionally, more than one grout strip may be formed, for example, one on either side of the rebar 14.

Figure 2:
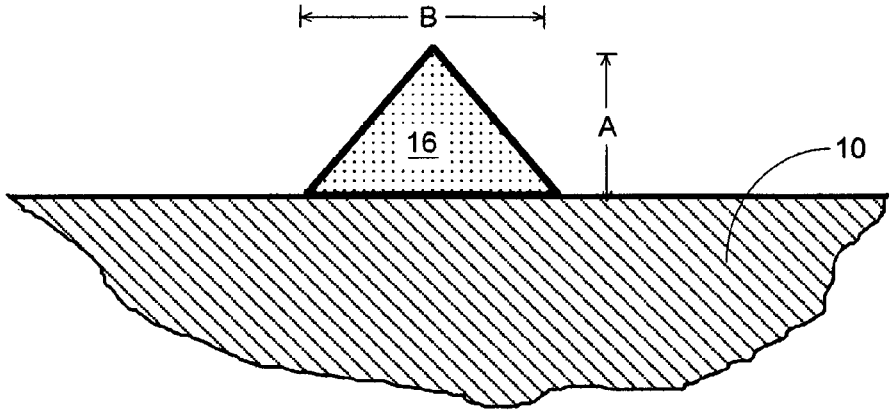
FIG. 2 is a cross-section of a grout strip applied to a concrete slab, showing exemplary dimensions of the grout strip.

As can be seen in FIGS. 1 and 2, the grout strip 16 may have a triangular cross-section. FIG. 2 shows the grout strip 16 with a triangular cross-section with exemplary dimensions with an altitude "A" to base "B" ratio of 3:5. The grout strip 16 may be shaped with a generally right-triangular cross-section, oriented with the equilateral sides forming a peak pointing generally upwardly from the surface. This may, in turn, provide a relatively large area of contact with a subsequently formed concrete portion while limiting the amount of grout used. Other grout strip cross-sections may be used, such as curved, jagged, regular or irregular shapes, or varying shapes along the length of the strip 16.

Once the grout strip 16 has been positioned and shaped as desired, the grout strip and surrounding joint area 12 may be treated with a cementitious and reactive waterproofing slurry sealant 18 which may be a less concentrated aqueous suspension of sealant than the grout 16. Such water-reactive crystal forming slurry sealants may react with water to facilitate crystalline growth, which may fill or plug surface pores or capillaries, preventing water migration. After application, water-reactive chemicals in the sealant may remain dormant in anhydrous conditions. However, the dormant chemicals may be reactivated in the presence of water to form additional water migration-impeding crystalline growth.

Thus, interposing such a slurry sealant between adjacent concrete layers may prevent water from migrating through the intersection, since water may trigger crystal formation, which may in turn block an aperture through which water may migrate. Moreover, cracks in the concrete may form subsequent to pouring due to settling or mechanical fatigue, which may provide new water migration paths. However, the "self-sealing" nature of the sealant chemicals may fill or plug such paths with crystal growth upon contact with moisture that has moved through the paths.

Any suitable cementitious and reactive waterproofing slurry sealant may be used. For example, sealants which conform to CSI Master Format 2004 071600 or CSI Master Format 2004 071616 may be used. Exemplary sealants include Krystol waterproofing mixture as available from the Kryton Group of Companies of Vancouver, B.C., Canada. The physical and/or chemical composition of the slurry sealant may be a factor in the selection of a desired material for creating a waterstop joint. For example, Krystol is a concrete compatible powder that may be aqueously suspended in varying concentrations, such as to create a putty or slurry. Krystol is also available in waterstop grout form and in slurry form.

Depending on the makeup of the slurry and/or grout strip, a chemical bond formed between the grout strip 16 and the concrete surface upon which the grout strip is formed may be strengthened and rendered impermeable to moisture when the concrete has a damp, porous surface. Moisture may promote crystalline growth, and pores may allow penetration of crystalline formation into the concrete surface. Thus, a preliminary, preparatory step such as grinding, water-blasting, shot-blasting, or similar means, may be performed to create, or increase the porosity of, a porous concrete surface to which the grout strip 16 or slurry 18 is applied.

Further, the grout strip 16 may be allowed to dry, or set prior to slurry 18 treatment. The selection of drying/setting time, as those skilled in the art will appreciate, may relate to such factors as grout strip size and shape, concrete surface conditions, ambient conditions, chemical makeup of the grout strip and/or slurry, and so forth. These characteristics also may affect any chemical bonding reaction between the slurry sealant and the concrete surface.

Slurry 18 may be applied to the intended joint area 12 of the concrete surface in any suitable method, such as by brush or roller. Applying slurry 18 with a bristled concrete brush may achieve a desired degree of contact and penetration. Slurry 18 may be applied within or beyond the intended joint area 12 over which a subsequent concrete portion will be poured. In FIG. 1, for example, the treated area of the horizontal concrete surface has an irregular ulterior border, within which a vertical concrete wall will be poured.

Similar to the grout strip 16, the slurry 18 may be allowed to dry prior to a subsequent concrete pour. Since any water-reactive chemicals of the slurry sealant 18 may remain dormant after the joint is formed, a subsequent concrete portion may be poured over the treated surface at any time appropriate for the slurry sealant selected.

A second, adjacent concrete portion may then be poured or formed over the grout strip 16 and slurry 18 treated surface 12 to complete the installation of the waterstop joint. Optionally, only the grout strip 16 or the slurry 18 may be used, or additional grout strips or slurries may be used.

Figure 3:
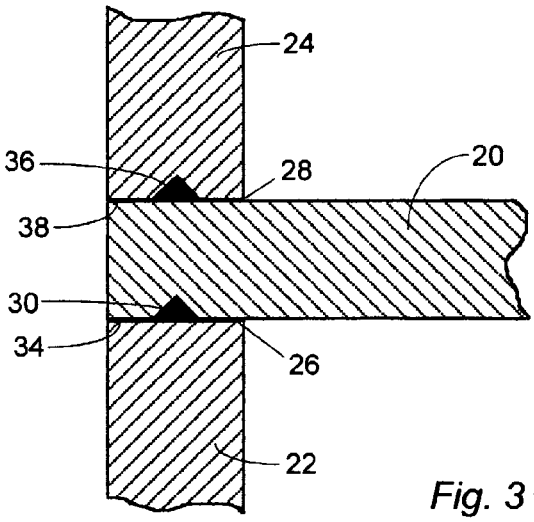
FIG. 3 is a cross-section of two concrete wall-to-slab joints, showing sealant slurry and grout strips applied between adjacent concrete portions.

FIG. 3 shows an exemplary cross-section of a portion of a concrete slab 20 interposed between two concrete walls 22 and 24 creating two wall-to-slab joints 26 and 28 where the walls meet the slab. Thus, there is provided first and second concrete portions, such as the concrete walls 22 and 24 illustrated by way of example in FIG. 3, respectively, and portions of the concrete walls 22 and 24 illustrated by way of example in FIG. 3, respectively.

Viewed from a first aspect, FIG. 3 illustrates two horizontal joints 26 and 28 viewed from the side where the slab 20 represents a horizontal slab and walls 22 and 24 represent lower and upper walls, respectively. Here, the concrete sections are placed in sequence 22, 20, 24. To create wall-to-slab joint 26, the joint area of lower wall 22 is preferably brought to a SSD condition. A grout strip 30 is applied to the top surface of the joint area of lower wall 22. The grout strip 30 and joint area of lower wall 22 are then covered with slurry 34 and slab 20 is poured over the grout strip 30 and slurry 34. To create wall-to-slab joint 28, the top surface of the joint area of slab 20 is preferably brought to a SSD condition. A grout strip 36 is applied to the top surface of the joint area of slab 20. The grout strip 36 and joint area of slab 20 are then covered with slurry 38 and upper wall 24 is poured over the grout strip 36 and slurry 38.

Alternatively, viewed from a second aspect, FIG. 3 illustrates two vertical joints 26 and 28 viewed from above where the slab 20 now represents a vertical wall and walls 22 and 24 represent left and right walls, respectively. Here, the concrete sections are placed in sequence 24, 20, 22. To create wall-to-wall joint 28, the joint area of right wall 24 is preferably brought to a SSD condition. A grout strip 36 is applied to the top surface of the joint area of right wall 24. The grout strip 36 and joint area of right wall 24 are then covered with slurry 38 and vertical wall 20 is poured over the grout strip 36 and slurry 38. To create wall-to-wall joint 26, the joint area of vertical wall 20 is preferably brought to a SSD condition. A grout strip 30 is applied to the top surface of the joint area of vertical wall 20. The grout strip 30 and joint area of vertical wall 20 are then covered with slurry 34 and left wall 22 is poured over the grout strip 30 and slurry 34. As those skilled in the art will appreciate, a keyway created in the concrete wall sections will ease construction of the joints.

It is believed that the disclosure set forth above encompasses multiple distinct embodiments and methods with independent utility. While each of these embodiments and methods may have been disclosed in a preferred form, the specific embodiments and methods as disclosed and illustrated herein are not to be considered in a limiting sense as numerous variations are possible. The subject matter of the embodiments and methods includes all novel and non-obvious combinations and subcombinations of the various elements, features, steps, functions and/or properties disclosed herein.

Inventions embodied in various combinations and subcombinations of features, functions, elements, and/or properties may be claimed through presentation of claims in a related application. Such claims, whether they are directed to embodiments or methods different from those disclosed herein or directed to the same, whether different, broader, narrower or equal in scope to the described embodiments and methods, are also regarded as included within the subject matter of the present disclosure.

What is claimed is:

1. A method of constructing a concrete waterstop joint between first and second concrete portions comprising applying a continuous longitudinal cementitious and reactive waterproofing grout strip to a top surface of a joint area of said first concrete portion and forming said second concrete portion over said grout strip such that said grout strip is self-sealing by chemically reacting in the presence of moisture to cause crystalline growth by crystalline formation for blocking migration of said moisture.

2. The method of claim 1 further comprising bringing said top surface of said joint area of said first concrete portion to a saturated/surface dry (SSD) condition prior to applying said continuous longitudinal cementitious and reactive waterproofing grout strip.

3. The method of claim 1 further comprising applying a cementitious and reactive waterproofing slurry to said top surface of said joint area.

4. The method of claim 1 or 3 further comprising applying a cementitious and reactive waterproofing slurry to said grout strip.

5. The method of claim 1, 3 or 4 further comprising forming the second concrete portion over said top surface of said joint area.

6. The method of claim 1 wherein said grout strip is formed to have a triangular cross-section.

7. The method of claim 6 wherein said triangular grout strip is formed to have an altitude to base ratio of 3:5.

8. The method of claim 1 wherein said grout strip is positioned substantially centrally along said top surface of said joint area.

9. The method of claim 1 wherein applying a continuous longitudinal cementitious and reactive waterproofing grout strip to a top surface of a joint area of said first concrete portion and forming said second concrete portion over said grout strip comprises applying said grout strip consisting of a putty when said grout strip is applied to said top surface of said joint area.

10. Use of a cementitious and reactive waterproofing grout strip in the construction of a concrete waterstop joint between a first concrete portion and a second concrete portion, said use comprising applying said grout strip to a top surface of a joint area of said first concrete portion such that said grout strip is self-sealing by chemically reacting in the presence of moisture to cause crystalline growth by crystalline formation for blocking migration of said moisture.

11. The use as defined in claim 10 further comprising using a cementitious and reactive waterproofing slurry on said top surface of said joint area.

12. The use as defined in claim 10 or 11 further comprising using a cementitious and reactive waterproofing slurry on said grout strip.

13. The use as defined in claim 10 wherein said grout strip has a triangular cross-section.

14. The use as defined in claim 13 wherein said triangular grout strip has an altitude to base ratio of 3:5.

15. The use as defined in claim 10 wherein said grout strip is positioned substantially centrally along said top surface of said joint area.

16. The use as defined in claim 10 wherein said grout strip consists of a putty when said grout strip is applied.

17. A concrete waterstop joint comprising:

a first concrete portion having a top surface joint area;

a continuous cementitious and reactive waterproofing longitudinal grout strip-connected to said top surface joint area; and a second concrete portion formed over said grout strip, wherein said grout strip is self-sealing by chemically reacting in the presence of moisture to cause crystalline growth by crystalline formation for blocking migration of said moisture.

18. The concrete waterstop joint of claim 17 further comprising a cementitious and reactive waterproofing slurry applied to said top surface joint area.

19. The concrete waterstop joint of claim 17 or 18 further comprising a cementitious and reactive waterproofing slurry applied to said grout strip.

20. The concrete waterstop joint of claim 17, 18 or 19 wherein said second concrete portion is formable over said top surface joint area.

21. The concrete waterstop joint of claim 17 wherein said grout strip has a triangular cross-section.

22. The concrete waterstop joint of claim 21 wherein said triangular grout strip has an altitude to base ratio of 3:5.

23. The concrete waterstop joint of claim 17 wherein said grout strip is positioned substantially centrally along said top surface joint area.

24. The concrete waterstop joint of claim 17 wherein said grout strip consists of a putty when said grout strip is being connected to said top surface joint area.

* * * * *